United States Patent [19]

Wen

[11] 4,257,376

[45] Mar. 24, 1981

[54] SINGLE INJECTOR, SINGLE POINT FUEL INJECTION SYSTEM

[75] Inventor: Gene Y. Wen, Troy, Mich.

[73] Assignee: The Bendix Corporation, Southfield, Mich.

[21] Appl. No.: 934,434

[22] Filed: Aug. 17, 1978

[51] Int. Cl.[3] ..... F02M 39/00

[52] U.S. Cl. ..... 123/472; 123/471; 123/482

[58] Field of Search ..... 123/139 AW, 119 R, 32 AE, 123/128

[56] References Cited

U.S. PATENT DOCUMENTS

| | | | |
|---|---|---|---|
| 3,608,531 | 9/1971 | Barendale | 123/139 AW |
| 3,646,914 | 3/1972 | Mennesson | 123/139 AW |
| 4,109,669 | 8/1978 | Rivere | 123/32 EA |

*Primary Examiner*—Ronald B. Cox

*Attorney, Agent, or Firm*—Gaylord P. Haas, Jr.; Russel C. Wells

[57] ABSTRACT

A flow regulating device for use in a single-point control electronic fuel injection system. The flow regulating device receives a discrete, pressurized fuel pulse or charge from a fuel injector and extends its time duration over the charge cycle period to approximate a continuous flow. The extended fuel charge is provided to an atomizer for mixture with air preparatory to being drawn into an engine intake manifold. In one embodiment of the invention, the flow regulating device includes a constant pressure valve together with a restricted flow passage. The pressure setting of the valve is below the pressure at which the discrete fuel charge is emitted from the injector, and the restricted passage has an orifice dimension smaller than that of the injector nozzle. In another embodiment of the invention, the flow regulating device takes the form of a pair of parallel connected constant pressure valves together with restricted flow passages. One constant pressure valve has a first pressure setting below the pressure in which the discrete fuel charge is emitted from the injector. The other constant pressure valve has a relatively higher pressure setting, but below that of the injector. The pair of constant pressure valves and passages cooperatively function to extend fuel charge duration in both high and low engine operating speeds.

35 Claims, 7 Drawing Figures

SINGLE INJECTOR, SINGLE POINT FUEL INJECTION SYSTEM

TECHNICAL FIELD

This invention relates to electronic fuel injection systems, and more particularly to a single-point injection system where the fuel supplied to a plurality of engine cylinders is controlled at a single point in the system.

BACKGROUND ART

Electronic fuel injection systems can be divided into two basic types. One type is a multi-point fuel injection system where each engine cylinder has associated with it an individual fuel injector that controls the injection timing and fuel metering for that cylinder. The other basic type is a single-point injection system where the fuel supplied to a plurality of engine cylinders is controlled by one or two injectors that are shared by the cylinders.

In a typical single-point fuel injection system the one or two fuel injectors are located upstream of the intake manifold. The actuation of each fuel injector is controlled by an electrical single from an engine control unit. The engine control unit is an electronic logic device, either programmable or hard wired, that controls fuel injection on the basis of several operating variables, including engine RPM, temperature, speed command, manifold air pressure and the like. The fuel injector is conventionally an electromagnetic valve this is open through the time duration of the signel from the engine control unit. The opening and closing of the fuel injector causes it to output a pressurized fuel pulse or charge of discrete time duration. This discrete fuel charge is provided to an atomizer where it is mixed with air. The air/fuel (A/F) mixture from the atomizer flows to the intake manifold, where it is drawn into the cylinders by the effect of passing through a decreasing pressure gradient.

There are at least two important reasons why single-point fuel injection is preferable over multi-point fuel injection. First, and of major importance, is the reduction in cost that is achieved when a separate fuel injector no longer needs to be provided for each individual engine cylinder. Instead, one fuel injector may service a plurality of engine cylinders and a considerable cost savings can be realized. Secondly, the single point fuel injection system facilitates more complete atomization of the fuel with air. More specifically, in a multi-point fuel injection system, each fuel injector is in close physical proximity to its respective engine cylinder and the injected fuel has less time to atomize before reaching the cylinder. However, in a single-point fuel injection system the fuel injector is positioned upstream of the intake manifold and the injected fuel has a relatively longer opportunity to atomize and become uniformly mixed before being drawn into the engine cylinders.

A special case of a single-point fuel injection system is a single-injector, single-point system. This is defined as a single-point fuel injection system where a single fuel injector services all of the cylinders in the engine. This type of system has the added advantage of requiring only a single fuel injector, and approaches an optimal cost reduction in electronic fuel injection design.

It is desirable in a single-point fuel injection system to provide some means intermediate the fuel injector and intake manifold to effectively stretch the time duration of the discrete, pressurized fuel charge output by the injector. By stretching the discrete fuel charge towards a more continuous flow, there will be less variation in the ratio of the A/F mixture passing through the intake manifold through each injection cycle. A uniform A/F ratio tends to improve engine performance and provides better emission control.

The present invention addresses the matter of uniform A/F ratio in a single-point electronic fuel injection system by making as its objective the design of a fuel injection flow regulating device that functions to moderate the discrete, pressurized fuel pulse from the injector into a more continuous fuel flow.

DISCLOSURE OF THE INVENTION

The present invention is a flow regulating device for use in conjunction with a single-point electronic fuel injection system. The device employs a controlled pressure setting and orifice opening to effectively stretch the time duration of the discrete, pressurized fuel pulse or charge from the injector into a more continuous flow.

The operation of the device is based upon the principle of flow continuity of fluid mechanics. More specifically, by a priori knowledge of the pressure of the fuel pulse as it is emitted by the injector and the dimension of the nozzle orifice of the injector, the pressure setting and orifice characteristics of the flow regulating device of the present invention can be selected to extend the time duration of the discrete fuel charge to approximate a continuous flow over the period of each charge cycle.

In a first embodiment of the invention, the flow regulating device takes the form of a constant pressure valve interconnected between the output of the fuel injector and a throttle body mounted over the engine intake manifold. The constant pressure valve has a pressure setting which is lower than the pressure at which the discrete fuel charge is emitted from the injector. Moreover, the fluid connection between the constant pressure valve and the throttle body includes an orifice that is restricted relative to the orifice dimension of the injector nozzle. By coordinating the pressure setting of the constant pressure valve and the restricted orifice associated with it, the flow regulating device will tend to stretch out the time duration of each discrete fuel charge emitted by the injector.

In the preferred form of the first embodiment of the invention, the constant pressure valve includes a valve body having first and second internal chambers separated by a flexural diaphragm. The flexing on the diaphragm actuates an internal valve that opens and closes fluid communication between external inlet and outlet ports. The diaphragm is provided with an aperture of preselected dimension to permit a controlled amount of fluid communication between the first and second chambers. The orifice has a damping function and tends to moderate the rate of oscillation of the diaphragm to provide a more even and less interrupted flow of fuel through the constant pressure valve. The fuel that flows across the aperture in the diaphragm is returned through another port in the valve body to drain.

In a second embodiment of the invention, the flow regulating device takes the form of a pair of parallel connected constant pressure valves. One valve has a first pressure setting below the pressure at which the fuel charge is emitted from the injector, and the other valve has a second pressure setting that is intermediate in value of the first pressure setting and the pressure at which the fuel charge is emitted from the valve. During low speed or idle operation of the engine, the first constant pressure valve at the relatively lowest pressure setting is adequate to handle the flow regulation of fuel to the intake manifold. However, during high speed or high load engine operating conditions, the capacity of the first constant pressure valve is exceeded and the second constant pressure valve comes on-line to provide additional capacity. This form of pressure regulating device in conjunction with a restricted orifice flow passage is effective to extend or stretch the time duration of each injector fuel charge toward a continuous flow.

Other advantages of the present invention will be readily appreciated as the same becomes better understood by reference to the following detailed description when considered in connection with the accompanying drawings.

BEST MODE FOR CARRYING OUT THE INVENTION

Figure 1:
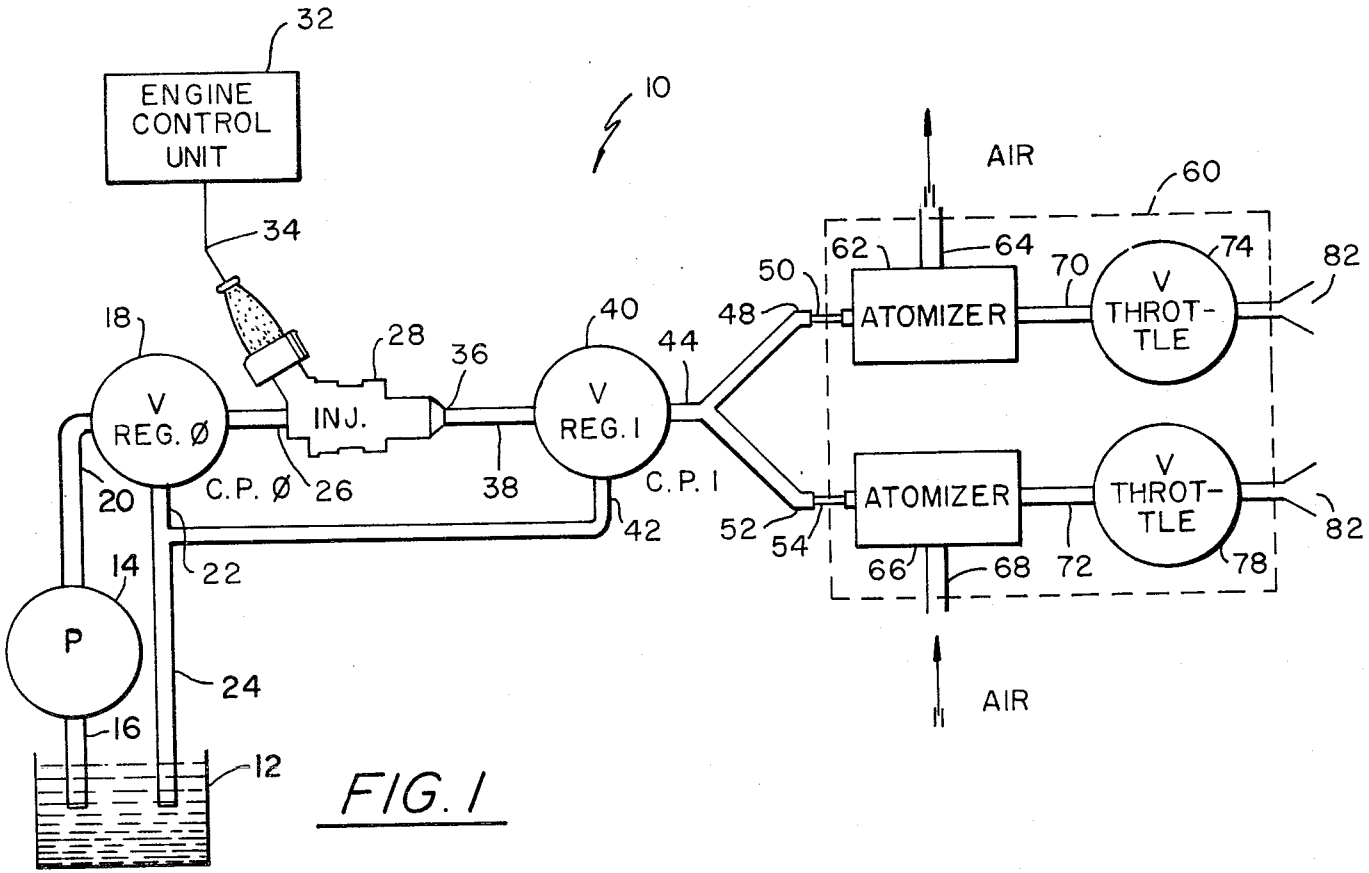
FIG. 1 is a schematic diagram of one form of a single-point, single-injector electronic fuel injection system incorporating the present invention.
Figure 2:
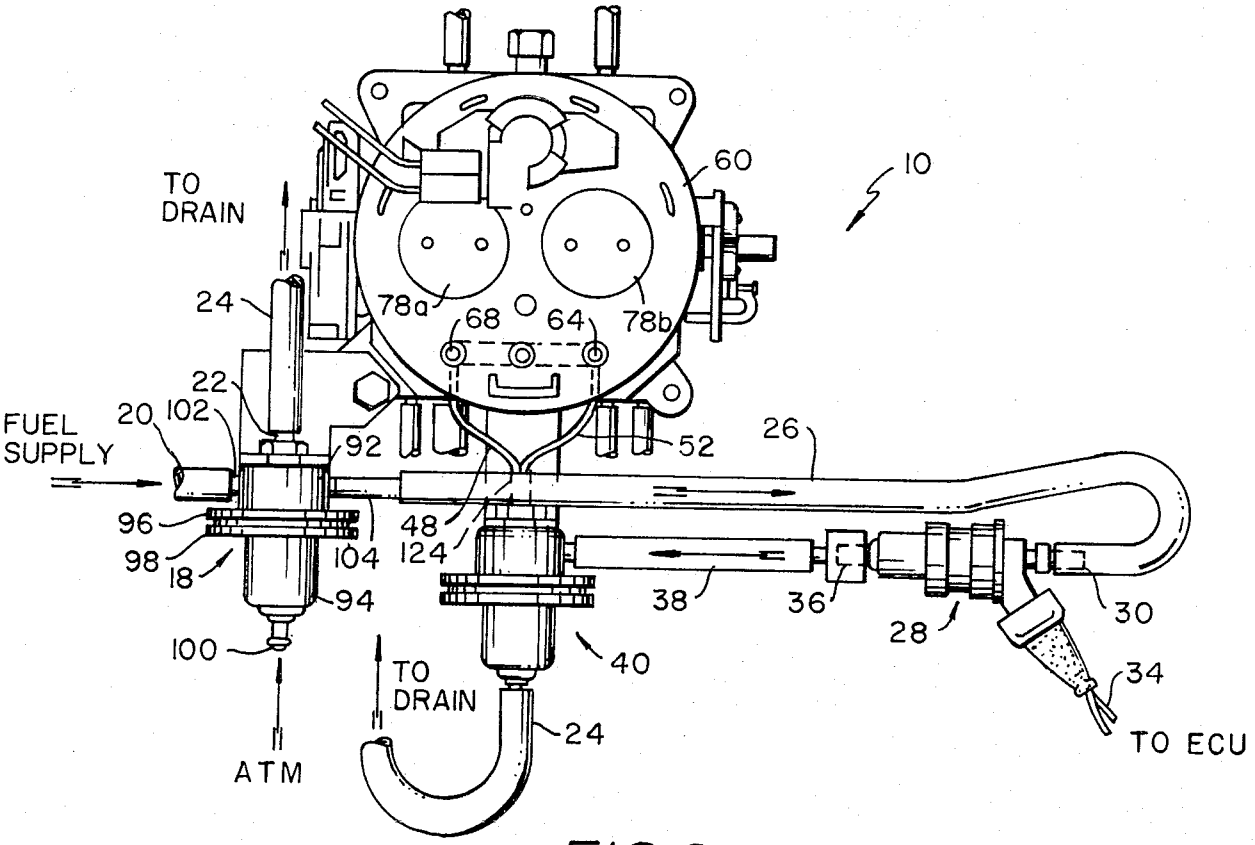
FIG. 2 is a diagrammatic view of a portion of the system of FIG. 1 that is pertinent for an understanding of the operation of the present invention.
Figure 3:
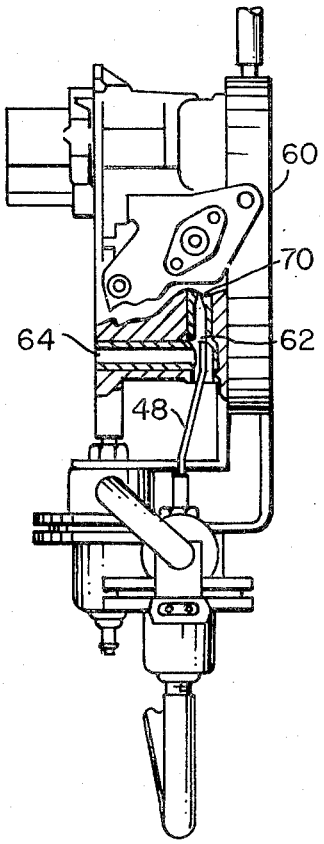
FIG. 3 is a side diagrammatic view of the portion of the system illustrated in FIG. 2.

A single-point, single-injector electronic fuel injection (EFI) system 10 of the type for which the present invention is adapted is shown schematically in FIG. 1 and diagrammatically in FIGS. 2 and 3. The schematic illustration of FIG. 1 will presently be described to provide a basic understanding of the invention at a general level, and as a background for understanding the practical embodiment of FIGS. 2 and 3. The EFI system 10 includes a novel flow regulating device that allows a single injector to service a plurality of engine cylinders.

With reference to FIG. 1, the EFI system 10 includes a constant pressure fuel pump 14 that makes fuel available on a continuous basis. The pump 14 draws fuel from a fuel tank 12 through a line 16. The pump 14 is preferably a positive displacement pump as is known in the art.

A constant pressure valve 18 receives the continuous fuel output of the pump 14 through a line 20. The constant pressure valve has a regulated pressure setting of C.P.0. to regulate the pressure from the pump 14 to a constant level suitable for injection. The constant pressure valve 18 has a drain port 22 that communicates with a drain line 24 to return any fuel in excess of the capacity of the valve 18 back to the fuel tank 12. The constant pressure valve 18 may be of conventional design and its detailed construction is not essential to an understanding of the present invention.

A fuel injector 28 receives fuel from the constant pressure valve 18 through a fuel line 26. The injector 28 responds to an electrical single from an engine control unit (ECU) 32 to produce a discrete pressurized fuel pulse or charge. The ECU 32 is electrically interconnected with the injector 28 through leads schematically indicated by 34. The injector 28 can be characterized for later analysis by the pressure level at which it outputs its fuel charge and the dimension of the orifice in its output nozzle 36. These two parameters will basically determine the flow characteristics of each discrete fuel charge emitted from the injector 28.

In accordance with the present invention, each discrete pressurized fuel charge from the injector 28 is supplied through a line 38 to another constant pressure valve 40. The constant pressure valve 40 has a regulated pressure setting C.P.1, which is below the pressure at which each discrete fuel charge is emitted from the injector 28. The constant pressure valve 40, as will hereinafter be discussed in detail, includes a drain port 42 which communicates with the drain line 24 to return fuel to the fuel tank 12 at a fixed rate.

The constant pressure valve 40 has an outlet port 44 that bifurcates or divides into parallel paths 48 and 52. Each of the paths 48 and 52 includes a restricted passage or orifice 50 and 54, respectively. Each of the orifices 50 and 54 is of relatively smaller dimension than the orifice in the nozzle 36 of the injector 28.

The constant pressure valve 40 and its associated fuel paths 48 and 52 cooperate to define a flow regulating device that effectively stretches or extends the time duration of each discrete pressurized fuel charge from the injector 28. The flow regulating device as defined uses a preselected pressure setting and orifice dimension to increase the time duration of each fuel charge.

Each of the parallel fuel paths 48 and 52 supply fuel to respective atomizers 62 and 66. The atomizer 62 has an air inlet port 64, and the air atomizer 66 has an air inlet port 68. In each of the atomizers 62 and 66, air is mixed with fuel to provide a combustible air/fuel mixture.

Each of the atomizers 62 and 66 has a respective outlet line 70 and 72. The flow through line 70 leads to a throat containing a throttle valve 74. The flow through line 72 leads to another throat containing a throttle valve 78. In the actual embodiment of FIG. 2, as will presently be discussed, the atomizers 62 and 66 and throttle valves 74 and 78 are housed within a throttle body 60.

The throttle valve 74 communicates with a fuel passage 80 that leads to an intake manifold 82, and the throttle valve 78 likewise communicates with a fuel passage 84 that opens into the intake manifold 82. The air/fuel mixture passing through the intake manifold 82 is provided directly to the engine cylinders.

FIGS. 2 and 3 are a diagrammatic view of the electronic fuel injection system 10 schematically illustrated in FIG. 1.

In FIG. 2, fuel is supplied from the fuel pump (not shown) through the line 20 to the constant pressure valve 18. The constant pressure valve 18 has a regulated pressure setting of C.P.0. The constant pressure valve 18 includes an upper chamber housing 92 and a lower chamber housing 94 that are joined in a fluid seal by a pair of integral, annular flanges 96 and 98. A flexural diaphragm (not shown) provides an internal boundary wall between the upper chamber housing 92 and lower chamber housing 94. The flexing of the diaphragm opens and closes an internal valve to regulate the outlet pressure of the valve 18 at the regulated pressure setting C.P.0.

The lower chamber housing 92 has a fluid inlet port 102 and a fluid outlet port 104. In addition, it includes the drain port 22 that connects with drain line 24 to return fuel to the tank 12 from the valve 18. The lower chamber housing 94 has an external port 100 that is open to the atmosphere.

The constant pressure valve 18 supplies fuel at the regulated pressure setting C.P.0 through the line 26 to the injector 28. The injector 28 has an inlet port 30 that connects to the fuel line 26. The injector 28 responds to an electrical signal on lines 34 from an engine control unit to emit a discrete pressurized fuel pulse or charge through the orifice in its nozzle 36. The dimension of the orifice in the nozzle 36 and the pressure at which the fuel charge are emitted are known parameters which can be used to determine he desired pressure and orifice size parameters of a fuel regulating device to increase the time duration of the discrete fuel charge from the injector.

Each discrete fuel charge from the injector 28 is supplied through line 38 to the constant pressure valve 40. The constant pressure valve 40 is shown in greater detail in FIG. 4 to which reference is made.

Figure 4:
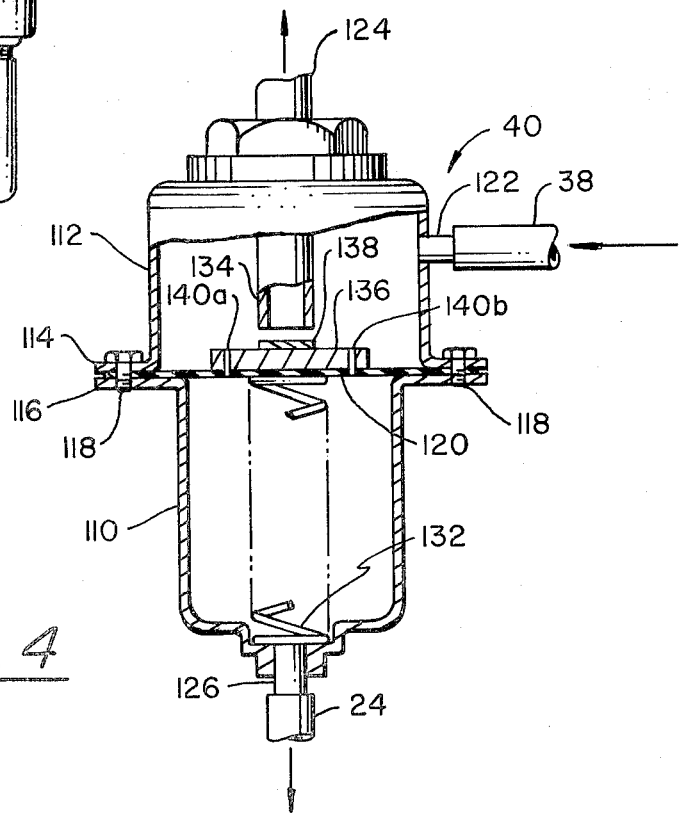
FIG. 4 is a detailed, diagrammatic view of a flow regulating device forming one embodiment of the present invention.

In FIG. 4, the constant pressure valve 40 includes a lower chamber housing 110 and an upper chamber housing 112. Each of the chamber housings 110 and 112 has a matched annular flange 118 and 114, respectively. The flanges are joined by fasteners 118 to form a fluid seal therebetween. A flexural diaphragm 120 is secured between flanges 114 and 118 and provides an internal boundary between the lower chamber housing 110 and the upper chamber housing 112.

The upper chamber housing 112 includes an inlet port 122 and an outlet port 124. The inlet port 122 receives each discrete pressurized fuel charge from the injector through line 38. The outlet port permits the outflow of fuel at the regulated pressure C.P.1. The lower chamber housing 110 has an external port 126 that connects with the drain line 24.

A compression spring 132 has one end supported against the interior wall of the lower chamber housing proximate the external port 126, and another end supported against the flexural diaphragm 120. The compression spring 132 has a spring constant k and is preloaded to correspond to the regulated pressure setting C.P.1.

The compression spring 132 controls the opening and closing of a valve in the upper chamber. The valve includes a tubular valve step 134 having one end in communication with the outlet port 124 and the other end proximate the flexural diaphragm 120. A valve closure member 136 is mounted on the flexural diaphragm 120 on the side opposite the compression spring 132. The closure member 136 supports a valve seat 138. The valve seat 138 closes off fluid communication between the upper chamber and outlet port 124 when bearing against the adjacent end of the tubular valve stem 134, and opens communication when not bearing thereagainst. The opening and closing of the internal valve is essentially a function of the flexing of the diaphragm 120 against the biasing of the compression spring 132.

In a novel feature of the invention, the upper chamber has a controlled amount of fluid communication with the lower chamber through apertures 140a and b in the valve closure member 136 and diaphragm 120. The apertures 140a and b tend to damp the oscillation of the diaphragm 120 by permitting a controlled amount of fuel to pass from the upper chamber to the lower chamber. The damping tends to smooth out the rapid opening and closing of the internal valve and thus provide a more stable and continuous flow of fuel through the valve via ports 122 and 124.

Referring to FIG. 2, the valve outlet port 124 divides into parallel fuel feed tubes 48 and 52. The inside diameter of the fuel feed tubes 48 and 52 is selected to provide the desired restrictive passage or orifice indicated by reference numerals 50 and 54 in FIG. 1. Each of the fuel feed tubes 48 and 52 supply fuel to a respective atomizer within the throttle body 60.

In FIG. 3, the atomizer 62 is shown as an internal chamber within the throttle body 60. Fuel is supplied to the atomizer chamber 62 through the fuel feed tube 48 and air is provided through the air inlet port 64. The air/fuel mixture atomizes in the chamber 62 and is passed therefrom through flow path 70. The throttle body 60 contains another atomizer chamber 66 (not shown) that receives fuel from the fuel feed tube 48 and air through the air inlet port 68.

With reference to FIG. 2, each of the atomizer chambers 62 and 66 communicate with a respective throat in the throttle body containing the throttle valves 74 and 78, respectively. The air/fuel mixture passing across the throttle valves 74 and 78 is channeled through the engine intake manifold (82 in FIG. 1, not shown in this view) to the cylinders.

The time duration of each fuel charge emitted by the injector 28 is effectively stretched or extended as it passes through the constant pressure valve 40 and fuel feed tubes 48 and 52. By selecting the regulated pressure setting C.P.1 of the valve 40 to be below the known pressure at which the fuel charge is emitted by the injector, and selecting the inside diameter of the fuel feed tubes 48 and 52 to represent an orifice smaller than the orifice in the nozzle 36 of the injector, the time duration of the fuel charge can be increased in accordance with the continuity principle of fluid mechanics.

Figure 5:
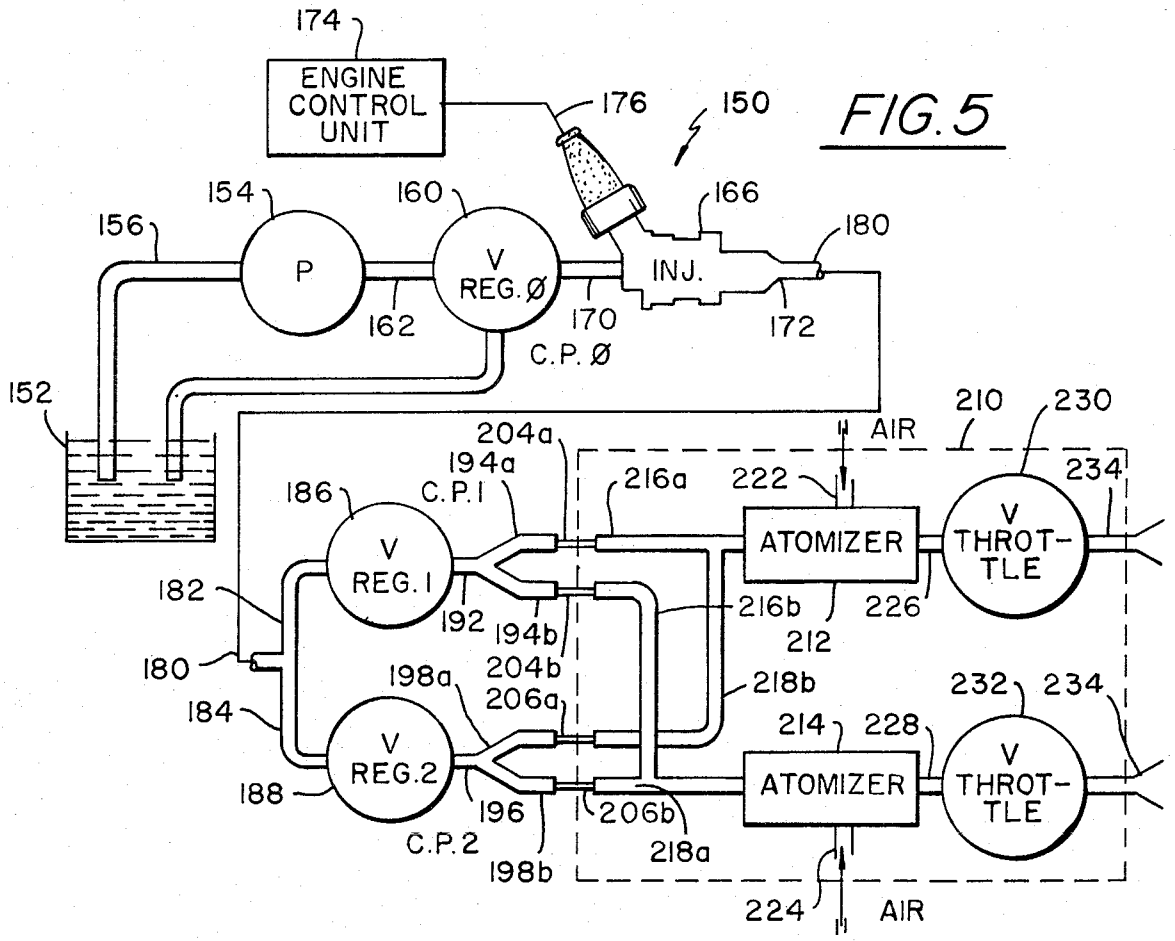
FIG. 5 is a schematic diagram of an alternative embodiment of a single-point, single-injector fuel injection system incorporating the present invention.

In FIG. 5 there is shown in schematic form a second, alternative embodiment of an electronic fuel injection (EFI) system 150 of the type for which the present invention is adapted. The EFI system 150 is shown in diagrammatic form in FIG. 6. The schematic illustration of FIG. 5 will first be discussed to provide a basic understanding of the invention at a general level and provide a background for understanding the practical embodiment of FIG. 6. The EFI system 150 employs a second form of flow regulating device to extend the time duration of a discrete pressurized fuel charge from an injector toward an approximation of a continuous flow. The organization of the EFI system 150 is basically similar to that of the EFI system 10 of FIG. 1, as the following description will disclose.

With reference to FIG. 5, the EFI system 150 includes a constant pressure pump 154. The constant pressure pump 154 draws fuel from a fuel tank 152 through a line 156. The pump 154 outputs fuel through fuel line 162.

A constant pressure valve 160 receives the fuel at the upper pressure level from line 162. The function of the constant pressure valve is to step down the pressure from the upper pressure level to a relatively lower constant pressure C.P.0. The constant pressure valve 160 connects to a drain line 164 to return to the fuel tank 152 any fuel in excess of the capacity of the constant pressure valve.

An injector 166 of conventional type receives the fuel supplied by the constant pressure valve 160 through a fuel line 170. The injector 166 responds to an electrical signal on line 176 from an engine control unit 174 to produce a discrete pressurized fuel charge. The fuel charge is emitted through an orifice in the nozzle 172 of the injector 166 at a predetermined pressure level.

The discrete pressurized fuel charge emitted by the injector 166 is transmitted through line 180 to the parallel connection of first and second constant pressure valves 186 and 188, respectively. The constant pressure valve 186 is communicated to the fuel line 180 by an inlet line 182, and similarly, the constant pressure valve 188 is communicated to the fuel line 180 by an inlet line 184.

The first constant pressure valve 186 has a regulated pressure setting C.P.1 that is low relative to the constant pressure setting C.P.0 of the constant pressure valve 160. The constant pressure setting of C.P.1 may be, e.g. 12 p.s.i. The second constant pressure valve 188 has a regulated pressure setting C.P.2 that is intermediate in value to the pressure setting of constant pressure valve 160 and the first constant pressure valve 186. A representative value of the C.P.2 is 14 p.s.i.

Each of the constant pressure valves 186 and 188 has an outlet that develops into a divided pair of flow lines. Specifically, the first constant pressure valve 186 has an outlet line 192 that develops into a pair of flow lines 194*a* and *b*. Similarly, the second constant pressure valve 188 has an outlet 196 that develops into a pair of flow lines 198*a* and *b*. Each of the flow lines 194*a* and *b* and 198*a* and *b* has a restricted passage or orifice that has a dimension smaller than that of the orifice of the injector nozzle 172. Specifically, the flow line 194*a* has a restricted passage 204*a*, the flow line 194*b* has a restricted passage 204*b*, the flow line 198*a* has a restricted passage 206*a*, and the flow line 198*b* has a restricted passage 206*b*.

The regulated pressure settig C.P.1 and C.P.2 of the first and second constant pressure valves 186 and 188 are selected along with the dimension of the restricted passages or orifices 204*a* and *b* and 206*a* and *b* to effectively stretch or extend the time duration of a discrete pressurized fuel charge emitted by the injector 166 in accordance with the continuity principle of fluid mechanics.

A pair of atomizers 212 and 214 receive the time extended fuel charge from the lines 204 and 206. Specifically, the atomizer 212 has inlet lines 216*a* and 218*b* that communicate the respective passages 204*a* and 206*a* with the atomizer. In addition, the atomizer 212 has an air inlet port 222 to provide air for mixture with the fuel received in the atomizer. The atomizer 214 has inlet lines 218*a* and 216*b* that communicate the respective passages 216*b* and 218*a* with the atomizer. In addition the atomizer 214 has an air inlet port 224 to provide air for mixture with the fuel received in the atomizer.

The flow from the atomizer 212 is through a flow line 226 across a throttle valve 230. The flow from the atomizer 214 is through a flow line 228 across a throttle valve 232.

The atomizers 212 and 214 and throttle valves 230 and 232 are contained in a throttle body schematically indicated by the dashed block 210. The air/fuel mixture flowing across the throttle valves 230 and 232 passes from the throttle body 210 to an intake manifold 234 for supply to the engine cylinders.

Figure 6:
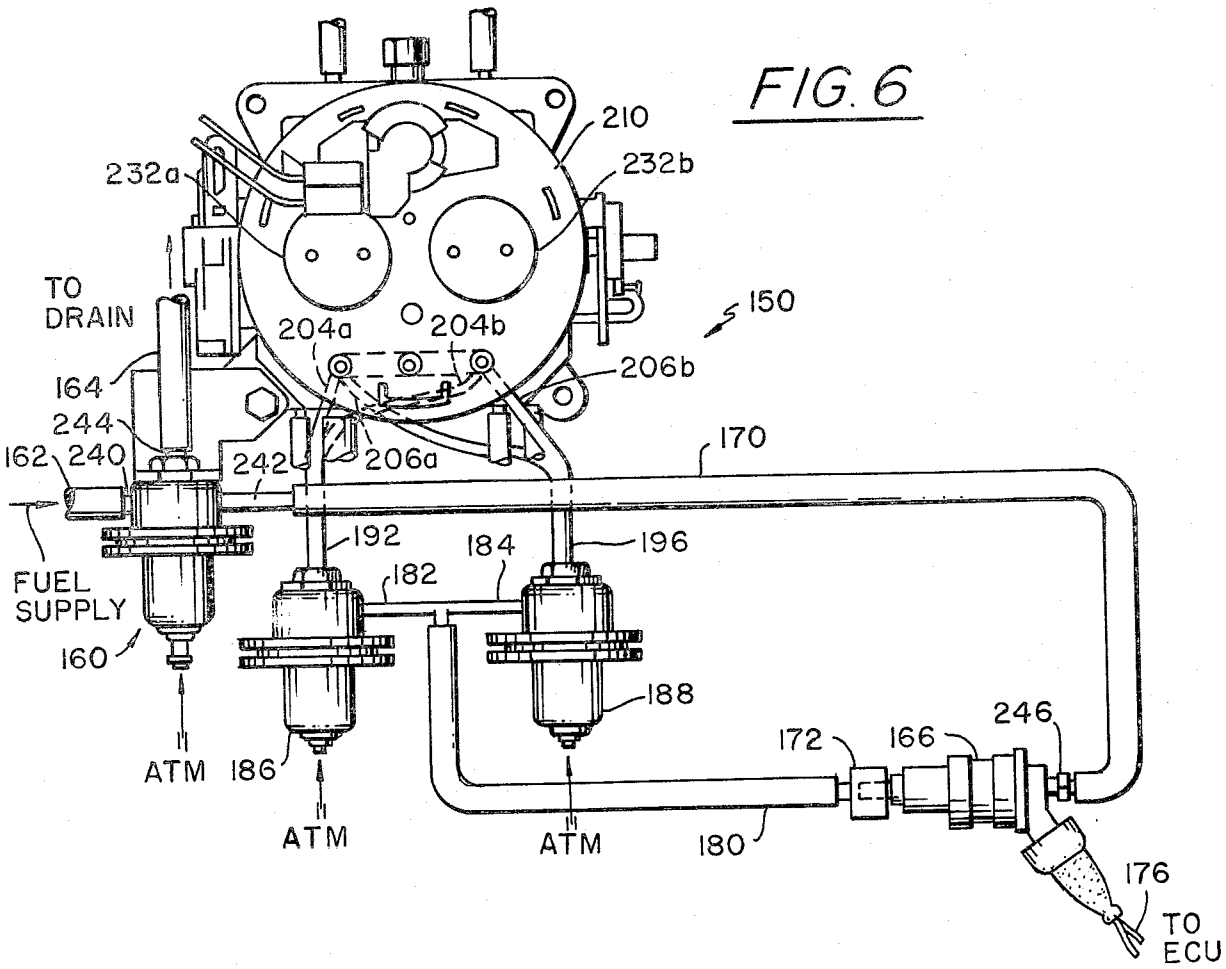
FIG. 6 is a diagrammatic view of a portion of the system schematically illustrated in FIG. 5 that is pertinent for an understanding of the operation of this embodiment of the invention.

Reference is made to FIG. 6 which is a diagrammatic view of a pertinent part of the EFI system 150 schematically illustrated in FIG. 5.

The EFI system 150 receives fuel from the fuel pump (not shown) through the line 162. The fuel is supplied to the inlet port 240 of the constant pressure valve 160. The constant pressure valve 160 is of conventional design similar to the constant pressure valve 18 of FIG. 2. The valve 160 has an outlet port 242 and a drain port 244. The outlet port 242 permits the outflow of fuel at the regulated pressure setting C.P.0. The drain port 244 connects to the drain line 164 to return to the fuel tank any fuel in excess of the capacity of the constant pressure valve 160.

The fuel through outlet port 242 is communicated through line 170 to an inlet 246 of the injector 166. The injector 166 responds to an electrical signal on lines 176 from the engine control unit (not shown) to emit a discrete pressurized fuel charge through its outlet nozzle 172. The outlet nozzle 172 has an orifice of predetermined dimension.

The discrete pressurized fuel charge from the injector 166 is communicated through line 180 to the parallel connection of the first and second constant pressure valves 186 and 188. The constant pressure valve 186 is communicated to line 180 through line 182, and the constant pressure valve 188 is communicated to the line 180 through line 184.

Figure 7:
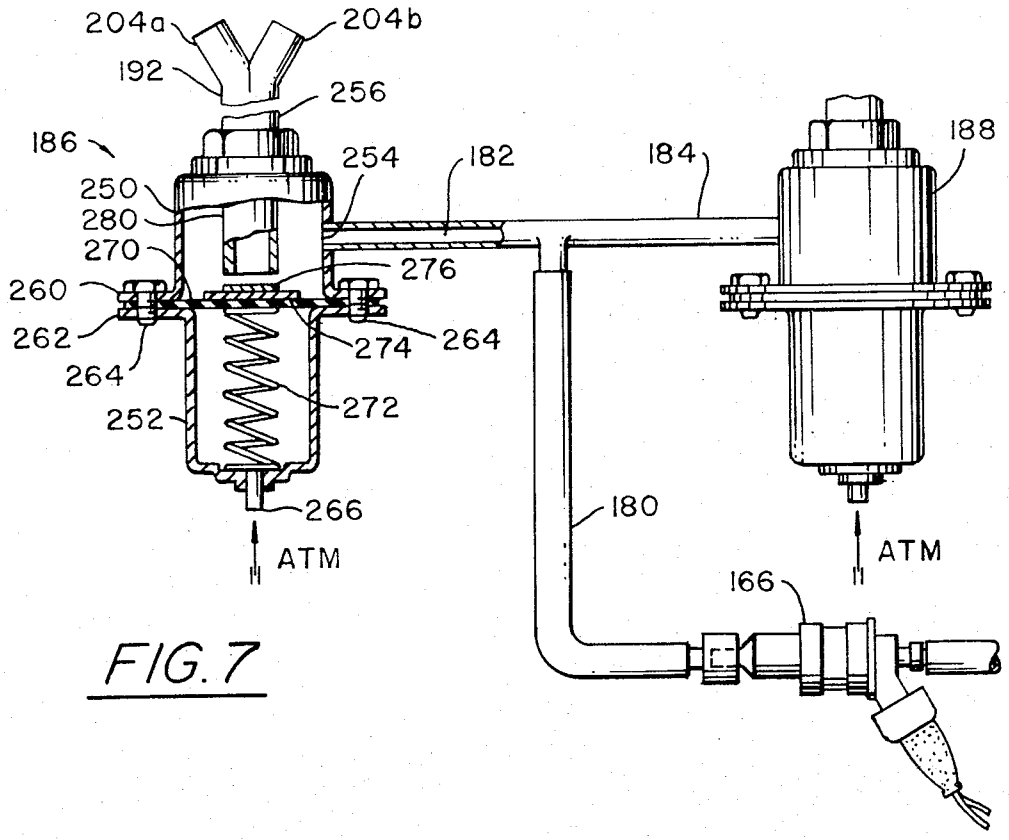
FIG. 7 is a detailed, diagrammatic view of a flow regulating device forming an alternative embodiment of the present invention.

Reference is made to FIG. 7, which shows the parallel connection of the first and second constant pressure valves 186 and 188 in detail.

The first constant presure valve 186 is described as exemplary of both the first and second constant pressure valves 186 and 188. The first constant pressure valve 186 comprises an upper chamber housing 250 and a lower chamber housing 252. The upper chamber housing 250 has an integral annular flange 260 that is secured to a matching annular flange 262 formed integrally with the lower chamber housing 252. A pair of fasteners 264 secures the annular flanges 260 and 262.

The upper chamber housing 250 has an inlet port 254 and an outlet port 256. The lower chamber housing has an external outlet port 266 that is in communication with the atmosphere.

A flexular diaphragm 270 is interposed and secured in a fluid seal between the annular flanges 260 and 262, and divides the volume within the constant pressure valve 186 into upper and lower chambers. The flexing of the diaphragm 270 controls the opening and closing of an internal valve in the upper chamber as will hereinafter be discussed in greater detail.

A flexular diaphragm 270 is biased against the influence of a compression spring 272. The compression spring 272 has one end bearing against the interior wall of the lower chamber housing 252 proximate the external outlet port 266, and another end bearing against one wall of the diaphragm 270. The compression spring 272 has a spring constant k and is preloaded to correspond to the pressure setting of the valve 186.

The diaphragm 270 has mounted on its other side a closure member 274. A valve seat 276 is mounted centrally on the closure member 274.

A tubular valve stem 280 has one end in communication with the outlet port 256 and another end proximate the flexular diaphragm 270 in registry with the valve seat 276. When the valve seat 276 bears against the adjacent end opening of the tubular valve stem 280, flow through the tubular valve stem is cut off. Conversely, when the valve seat 276 does not bear against the adjacent end opening of the tubular valve stem 280, the tubular valve stem is free to communicate the upper chamber with the outlet port 256.

The outlet port 256 communicates with line 192. The line 192 divides into a parallel connection of fuel feed lines 204*a* and *b*. The fuel feed lines 204*a* and *b* have a cross-sectional dimension that is relatively smaller than the dimension of the orifice in the nozzle 172 of the injector 166. The fuel feed tubes 204*a* and *b* were schematically indicated as the restricted passages of FIG. 5.

Referring to FIG. 6, it can be seen that the second constant pressure valve 188 which has a relatively higher regulated pressure setting C.P.2, but lower than that of the pressure at which a discrete fuel charge is emitted from the injector 166, also connects to an outlet line 196. The outlet line 196 develops into a pair of parallel fuel feed tubes 206*a* and *b*. The fuel feed tubes 204*a* and *b* are likewise of reduced cross-sectional diameter relative to the orifice in the nozzle 172 of the injector 166.

The fuel feed tubes 204*a* and *b* connect to a pair of atomizer chambers (not shown) within the throttle body 210 in the manner indicated in FIG. 5. The throttle body 210 includes a pair of throttle valves 230 and 232 in respective throat openings in the body.

In operation of the EFI system 150 of FIG. 6, a discrete pressurized fuel charge emitted by the injector 166 is communicated to the parallel connection of first and second constant pressure valves 186 and 188. At idle or low engine operating speeds, the first constant pressure valve 186 is adequate to handle the fuel supply requirement of the engine cylinders. At higher engine operating speeds, the second constant pressure valve 186 comes on-line to provide additional fuel supply capability. More specifically, if the fuel flow from the injector 166 exceeds the flow capacity of the first constant pressure valve 186, the fuel pressure will rise to exceed the regulated pressure setting C.P. 1 of the first constant pressure valve 186. The heightened fuel pressure will cause the second constant pressure valve 186 to open up or come on-line and allow fuel to flow through that valve. The total effective fuel supplied to the engine will be increased in accordance with the fuel requirements of the engine as determined by the engine control unit 174.

The effect of each discrete pressurized fuel charge emitted by the injector 166 passing through the parallel connection of the first and second constant pressure valves 186 and 188 will be to effectively stretch or extend the time duration of each fuel charge in accordance with the principles of fluid mechanics. In particular, by assigning the regulated pressure settings C.P.1 and C.P.2 of the first and second constant pressure valves 186 and 188, respectively, to be below the pressure level at which each discrete fuel charge is emitted from the injector 166, and further, to provide restricted passages or orifices, as represented by the fuel feed tubes 204*a* and *b* and 206*a* and *b*, of a cross-sectional dimension smaller than the dimension of the orifice in the injector nozzle 172, each fuel charge emitted by the injector 166 will be stretched or extended in timed duration to approximate a continuous flow.

The invention has been described in an illustrative manner, and it is to be understood that the terminology which has been used is intended to be in the nature of words of description, rather than of limitation.

Many modifications and variations of the present invention are possible in light of the above teachings. It is, therefore, to be understood that the invention may be practiced otherwise than as specifically described.

The embodiments of the invention in which an exclusive property or privilege is claimed are defined as follows:

1. An engine fuel injection system wherein a fuel injector emits a controlled sequence of discrete fuel charges which are atomized and supplied through an intake manifold to a plurality of engine cylinders, comprising: flow control means, disposed intermediate the fuel injector and the intake manifold in a flow passage therebetween, for extending the time duration of each fuel charge emitted by the injector to convert the sequence of fuel charges to a continuous flow of fuel.

2. The fuel injection system as defined in claim 1 wherein the fuel injector has an outlet nozzle opening of a first dimension and the flow control means includes a fluid conduit having a flow restriction of a second, relatively smaller dimension.

3. The fuel injection system as defined in claim 1 wherein each of the fuel charges is at a predetermined pressure level at the injector nozzle, and the flow control means includes pressure regulator means, disposed in the flow passage intermediate the injector and the intake manifold, for regulating the pressure of each fuel charge to a relatively lower level.

4. The fuel injection system as defined in claim 1 wherein the system is of the single-point type and the manifold has an intake opening, and further comprising a throttle body connected to the manifold, the throttle body having at least one internal fluid passage between the flow control means and the manifold intake opening.

5. The fuel injection system as defined in claim 1 wherein the throttle body includes at least one atomization chamber forming part of the internal fluid passage.

6. The fuel injection system as defined in claim 1 wherein the flow control means includes pressure regulator means, disposed in the flow passage intermediate the fuel injector and the intake manifold, for regulating the pressure level of each fuel charge as it is emitted from the injector to a relatively lower pressure level.

7. The fuel injection system as defined in claim 1 wherein the pressure regulator means comprises at least one constant pressure valve.

8. The fuel injection system as defined in claim 7 wherein the constant pressure valve is defined by: a valve body having first and second internal chambers spearated by a flexural diaphragm, the second chamber having external fuel inlet and outlet ports; and valve means, actuatable by the flexural diaphragm, for communicating the inlet port to the outlet port only when the pressure in the second chamber is greater than the relatively lower pressure level.

9. The fuel injection system as defined in claim 8 wherein the valve means comprises a tubular valve stem disposed within the second chamber and having a central opening therethrough with one end in communication with the fuel outlet port and another end proximate the flexural diaphragm; a valve closure member mounted on the diaphragm in proximity to the other end of the valve stem to seat thereagainst in a normally closed relation; and bias means for biasing the valve closure member in its normally closed relation with the other end of the valve stem.

10. The fuel injection system as defined in claim 9 wherein the bias means comprises a spring interconnected between the flexural diaphragm and a stationary point on the valve body.

11. The fuel injection system as defined in claim 8 wherein the flexural diaphragm has at least one aperture formed through it to permit a controlled amount of fluid communication between the first and second internal chambers and thereby damp oscillation of the diaphragm.

12. The fuel injection system as defined in claim 11 wherein the first internal chamber of the valve body has an external outlet port for communicating fuel passing through an aperture in the flexural diaphragm back to drain.

13. The fuel injection system as defined in claim 1 wherein the pressure regulator means comprises first constant pressure valve means for regulating fluid pressure at a first predetermined pressure level, and second constant pressure means, connected in parallel flow relation across the first constant pressure means, for regulating fluid pressure at a second predetermined pressure level that is relatively greater than the first predetermined pressure level.

14. The fuel injection system as defined in claim 13 wherein each of the constant pressure valves is defined by: a valve body having first and second internal chambers separated by a flexural diaphragm, the second chamber having external fuel inlet and outlet ports; and valve means, actuatable by the flexural diaphragm, for communicating the inlet port to the outlet port only when the pressure in the second chamber is greater than the relatively lower pressure.

15. The fuel injection system as defined in claim 14 wherein the valve means comprises a tubular valve stem disposed within the second chamber and having a central opening therethrough with one end in communication with the fuel outlet port and another end proximate the flexural diaphragm; a valve closure member mounted on the diaphragm in proximity to the other end of the valve stem to seat thereagainst in a normally closed relation; and bias means for biasing the valve closure member in its normally closed relation with the other end of the valve stem.

16. The fuel injection system as defined in claim 15 wherein the bias means comprises a spring interconnected between the flexural diaphragm and a stationary point on the valve body.

17. A fuel system for supplying fuel to the cylinders of an internal combustion engine comprising: fuel supply means for providing a supply of fuel at a regulated pressure level; a fuel injector in communication with the fuel supply means and responsive to an injection signal for emitting a discrete fuel charge in response to the injection signal; an intake manifold in communication with the injector through a flow passage therebetween; and flow control means disposed in the flow passage intermediate the fuel injector and intake manifold for extending the time duration of each fuel charge emitted from the injector to thereby convert a succession of such fuel charges to a continuous flow of fuel.

18. The fuel system as defined in claim 17 further comprising an atomization chamber forming part of the flow passage wherein the emitted fuel pulses are mixed with air to form an air-fuel mixture.

19. The fuel system as defined in claim 1 wherein the fuel injector has an outlet nozzle opening of a first dimension and the flow control means includes a fluid conduit having a flow restriction of a second, relatively smaller dimension.

20. The fuel system as defined in claim 19 wherein each fuel charge is at a predetermined pressure level at the injector nozzle, and the flow control means includes pressure regulator means, disposed in the flow passage intermediate the injector and the intake manifold, for regulating the pressure of each fuel charge to a relatively lower level.

21. The fuel system as defined in claim 20 wherein the pressure regulator means comprises at least one constant pressure valve.

22. The fuel system as defined in claim 21 wherein the constant pressure valve is defined by: a valve body having first and second internal chambers separated by a flexural diaphragm, the second chamber having external inlet and outlet ports; and valve means, actuatable by the flexural diaphragm, for communicating the inlet port to the outlet port only when the pressure in the second chamber is greater than the relatively lower pressure level.

23. The fuel system as defined in claim 22 wherein the valve means comprises a tubular valve stem disposed within the second chamber and having a central opening therethrough with one end in communication with the fuel outlet port and another end proximate the flexural diaphragm; a valve closure member mounted on the diaphragm in proximity to the other end of the valve stem to seat thereagainst in a normally close relation; and bias means for biasing the valve closure member in its normally closed relation with the other end of the valve stem.

24. The fuel system as defined in claim 23 wherein the bias means comprises a spring interconnected between the flexural diaphragm and a stationary point on the valve body.

25. The fuel system as defined in claim 22 wherein the flexural diaphragm has at least one aperture formed through it to permit a controlled amount of fluid communication between the first and second internal chambers and thereby damp oscillation of the diaphragm.

26. The fuel system as defined in claim 25 wherein the first internal chamber of the valve body has an external outlet port for communicating fuel passing through an aperture in the flexural diaphragm back to drain.

27. The fuel system as defined in claim 20 wherein the pressure regulator means comprises first constant pressure valve means for regulating fluid pressure at a first predetermined pressure level, and second constant pressure means, connected in parallel flow relation across the first constant pressure means, for regulating fluid pressure at a second predetermined pressure level that is relatively greater than the first predetermined pressure level.

28. The fuel system as defined in claim 27 wherein each of the constant pressure valves is defined by: a valve body having first and second internal chambers separated by a flexural diaphragm, the second chamber having external fuel inlet and outlet ports; and valve means, actuatable by the flexural diaphragm, for communicating the inlet port to the outlet port only when the pressure in the second chamber is greater than the relatively lower pressure.

29. The fuel system as defined in claim 28 wherein the valve means comprises a tubular valve stem disposed within the second chamber and having a central opening therethrough with one end in communication with a fuel outlet port and the other end proximate the flexural diaphragm; a valve closure member mounted on the diaphragm in proximity to the other end of the valve stem to seat thereagainst in a normally closed relation; and bias means for biasing the valve closure member in its normally closed relation with the other end of the valve stem.

30. The fuel system as defined in claim 29 wherein the bias means comprises a spring interconnected between the flexural diaphragm and a stationary point on the valve body.

31. A method of injection fuel into a plurality of cylinders in an internal combustion engine comprising:

supplying pressurized fuel to a pulsed injection valve;

actuating the injector valve in response to engine fuel demand to produce a succession of discrete pressurized fuel pulses;

passing each pressurized fuel charge through a restricted passage to attenuate its pressure level, extend its time duration and convert said fuels charge to a continuous flow of fuel;

atomizing each extended fuel charge with air to produce an air-fuel mixture; and passing the air-fuel mixture through an intake manifold communicating with the engine cylinders.

32. An engine fuel injection system wherein a fuel injector emits a controlled sequence of discrete fuel charges which are atomized and supplied through an intake manifold to a plurality of engine cylinders, said fuel injector having an outlet nozzle opening of a first dimension, the system comprising: flow control means, disposed intermediate the fuel injector and the intake manifold in a flow passage therebetween, for extending the time duration of each fuel charge emitted by the injector to cause the sequence of fuel charges to approximate a continuous flow, said flow control means including a fluid conduit having a flow restriction of a second, relatively smaller dimension.

33. An engine fuel injection system of the single-point type wherein a fuel injector emits a controlled sequence of discrete fuel charges which are atomized and supplied through a throttle body, an intake manifold having an intake opening connected to the throttle body, to a plurality of engine cylinders, the throttle body having at least one internal fluid passage between the flow control means and the manifold intake opening, the system comprising: flow control means, disposed intermediate the fuel injector and the intake manifold in a flow passage therebetween, for extending the time duration of each fuel charge emitted by the injector to cause the sequence of fuel charges to approximate a continuous flow.

34. An engine fuel injection system of the single-point type wherein a fuel injector emits a controlled sequence of discrete fuel charges which are atomized and supplied through an intake manifold to a plurality of engine cylinders, the system comprising: flow control means, disposed intermediate the fuel injector and the intake manifold in a flow passage therebetween, for extending the time duration of each fuel charge emitted by the injector to cause the sequence of fuel charges to approximate a continuous flow, the flow control means including pressure regulator means, disposed in the flow passage intermediate the fuel injector and the intake manifold, for regulating the pressure level of each fuel charge as it is emitted from the injector to a relatively lower pressure level.

35. A fuel system for supplying fuel to the cylinders of an internal combustion engine comprising: fuel supply means for providing a supply of fuel at a regulated pressure level; a fuel injector in communication with the fuel supply means and responsive to an injection signal for emitting a discrete fuel charge in response to the injection signal; an intake manifold in communication with the injector through a flow passage therebetween; flow control means disposed in the flow passage intermediate the fuel injector and intake manifold for extending the time duration of each fuel charge emitted from the injector to thereby cause a succession of such fuel charges to approximate a continuous flow and an atomization chamber forming part of the flow passage wherein the emitted fuel pulses are mixed with air to form an air-fuel mixture.

* * * * *